US006173498B1

(12) United States Patent
Warrick et al.

(10) Patent No.: US 6,173,498 B1
(45) Date of Patent: Jan. 16, 2001

(54) RAZOR

(75) Inventors: Paul Leslie Warrick, Reading (GB); Daniel Brian Lazarchik, Boston, MA (US)

(73) Assignee: The Gillette Company, Boston, MA (US)

( * ) Notice: Under 35 U.S.C. 154(b), the term of this patent shall be extended for 0 days.

(21) Appl. No.: 09/240,404

(22) Filed: Jan. 29, 1999

Related U.S. Application Data

(63) Continuation of application No. PCT/US97/13099, filed on Jul. 28, 1997.

(30) Foreign Application Priority Data

Aug. 5, 1996 (GB) ..... 9616402

(51) Int. Cl.[7] ..... B26B 21/22
(52) U.S. Cl. ..... 30/50; 30/57
(58) Field of Search ..... 30/47, 50, 57

(56) References Cited

U.S. PATENT DOCUMENTS

| | | | | |
|---|---|---|---|---|
| 4,335,508 | | 6/1982 | Francis et al. | 30/47 |
| 4,516,321 | * | 5/1985 | Frabcus | 30/50 |
| 4,709,477 | | 12/1987 | Ferraro . | |
| 4,774,765 | * | 10/1988 | Ferraro | 30/50 |
| 4,932,123 | * | 6/1990 | Francis | 30/50 |
| 5,222,300 | | 6/1993 | Althaus et al. | 30/50 |
| 5,224,267 | * | 7/1993 | Simms et al. | 30/50 |
| 5,251,376 | | 10/1993 | Althaus et al. | 30/50 |
| 5,313,706 | * | 5/1994 | Motta et al. | 30/57 |
| 5,546,660 | * | 8/1996 | Burout et al. | 30/60 |

* cited by examiner

*Primary Examiner*—Hwei-Siu Payer
(74) *Attorney, Agent, or Firm*—Charles P. Boukus, Jr.; Donal B. Tobin

(57) ABSTRACT

A safety razor including at least one movable blade. The blade is moveable with respect to other parts of the razor. Movement of the blade increases the blade tangent angle in response to forces encountered during shaving.

11 Claims, 6 Drawing Sheets

RAZOR

This application is a continuation of PCT/US97/13099 filed Jul. 28, 1997.

This invention relates to safety razors, and in particular it is concerned with a blade unit for a safety razor. The blade units of the invention may be either cartridges which are mounted replaceably on a handle for use, or the shaving heads of disposable razors having blade carrying parts permanently attached to a handle. A safety razor cartridge as currently marketed comprises a generally rectangular moulded plastics frame with guard and cap surfaces on the lengthwise extending frame parts. Within the opening of the frame are a pair of blades arranged in tandem with their cutting edges parallel to each other and directed towards the guard surface. The blades are carried on respective supports to which they are fixedly attached, and the ends of the blade supports are slidably guided in grooves in the end walls of the frame to enable the blades to retract, under forces exerted on the blades during shaving. Springs act on the blades to urge them to a normal rest position.

It is well known that the so-called shaving geometry of a blade unit is important in determining the shaving performance of the blade unit. The shaving geometry defines the position and orientation of the blades in relation to other skin contacting parts, in particular the guard and cap, of the blade unit. One parameter of the shaving geometry is the blade exposure, which is the perpendicular distance by which the edge of a blade protrudes above a shaving plane tangential to the surfaces of the skin contacting parts immediately in front of and behind the blade edge. The known blade unit described above has the blades mounted so that the exposure is reduced when loads of sufficient magnitude to overcome the force of the springs are exerted on the blades. Another important factor in the shaving geometry is the blade tangent angle, which is the angle at which the central plane of the blade intersects the tangent plane, the tangent plane being the plane which is tangent to the edge of the blade and to the surface of the skin contacting part next in front of the blade. For example, in a twin blade cartridge, the blade tangent angle of the first or primary blade is the angle of the blade to the tangent plane tangential to the guard surface and the edge of the primary blade.

During shaving the blades of a blade unit are subjected to a combination of drag forces and load forces. Drag forces are those forces directed essentially parallel to the shaving plane, and load forces are those forces directed against the blade by the skin in the direction substantially perpendicular to the shaving plane.

It has been proposed for example in U.S. Pat. Nos. 4,709,477 and 4,774,765, to mount the blades so that the blades can move to increase both exposure and blade tangent angle in response to increasing drag forces. Strain gauge measurements have shown that drag forces do not vary substantially during shaving. Hairs do not usually grow perpendicular to the skin surface and for the majority of men beard hair is inclined downwardly with respect to the face. It is believed that, when shaving, men apply the razor against the face with less pressure during upstrokes, when the blades are moving essentially against the grain, than during downstrokes, and the net result is that drag forces are not substantially different during upstrokes and downstrokes. On the basis that by applying the razor against the skin surface under greater load pressure a person is seeking greater closeness of shave, a more aggressive blade geometry would be desirable under such conditions. The prior art razors with movable blades are not capable of responding to load forces in this way.

Accordingly, the present invention seeks to fill this gap left by the prior art and in accordance with the invention there is provided a safety razor blade unit having at least one blade mounted for independent movement relative to other skin contacting parts of the blade unit under forces exerted at the blade edge during shaving, wherein the or each blade is mounted to move to increase the blade tangent angle in response to load forces exerted on the blade during shaving.

In the preferred embodiments of this invention the blade unit includes a frame, and the or each blade is fixedly carried on a blade support, and the blade support is connected to the frame by means defining a fulcrum, the movement of the blade under load fulcrum being located closer to the blade edge than is the point where the tangent plane meets the skin contacting surface next in front of the blade. Also, the fulcrum lies in or closely adjacent to the tangent plane. This arrangement minimizes the changes in blade exposure as the blade tangent angle increases, and to the extent that the exposure of the blade does change it reduces as the blade tangent angle increases. Also, the angular displacement of the blade is largely insensitive to the drag forces on the blade, and the blade span, i.e. the distance between the blade edge and the skin contacting surface in front of the blade edge measured in the tangent plane, does not change significantly as the blade tangent angle increases. It is expedient for the fulcrum to be spaced from the blade edge at a distance in the range of 0.2 mm to 0.6 mm.

With a blade unit embodying the invention the blade or blades are initially set with a minimum blade tangent angle, and this angle increases under increasing load forces. As a consequence there is greater comfort as compared with other arrangements which provide the blade tangent angle to be initially set at a maximum.

The blade supports can conveniently be coupled to the frame so that the fulcrum is fixed with respect to the frame, but this is not essential and it is also possible to allow a degree of controlled movement of the fulcrum.

A better understanding of the invention will be gained from the detailed description which follows reference being made to the accompanying drawings in which.

Figure 1:
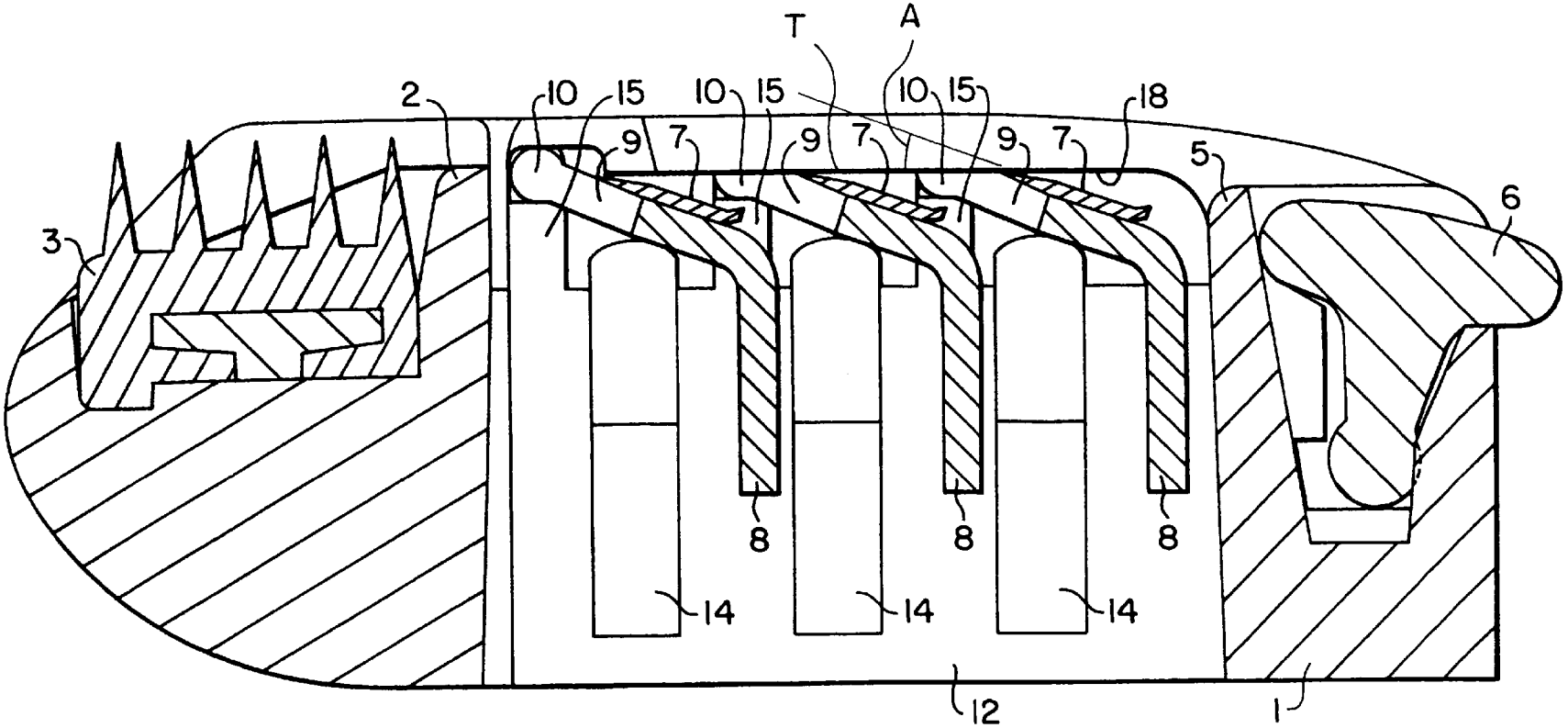
FIG. 1 is a cross-section through a razor cartridge in accordance with the invention, the blades being shown in a normal rest position.
Figure 2:
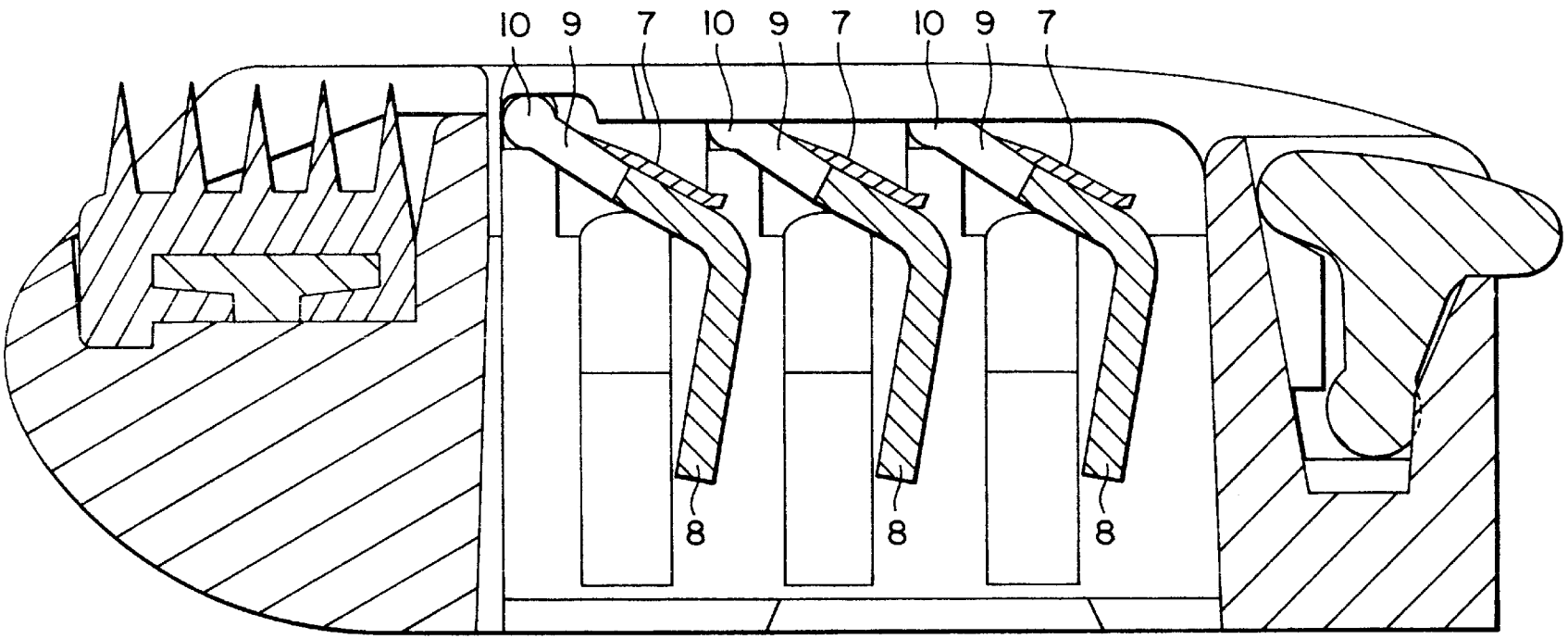
FIG. 2 shows the cartridge of FIG. I with the blades in the position of maximum angular displacement.
Figure 3:
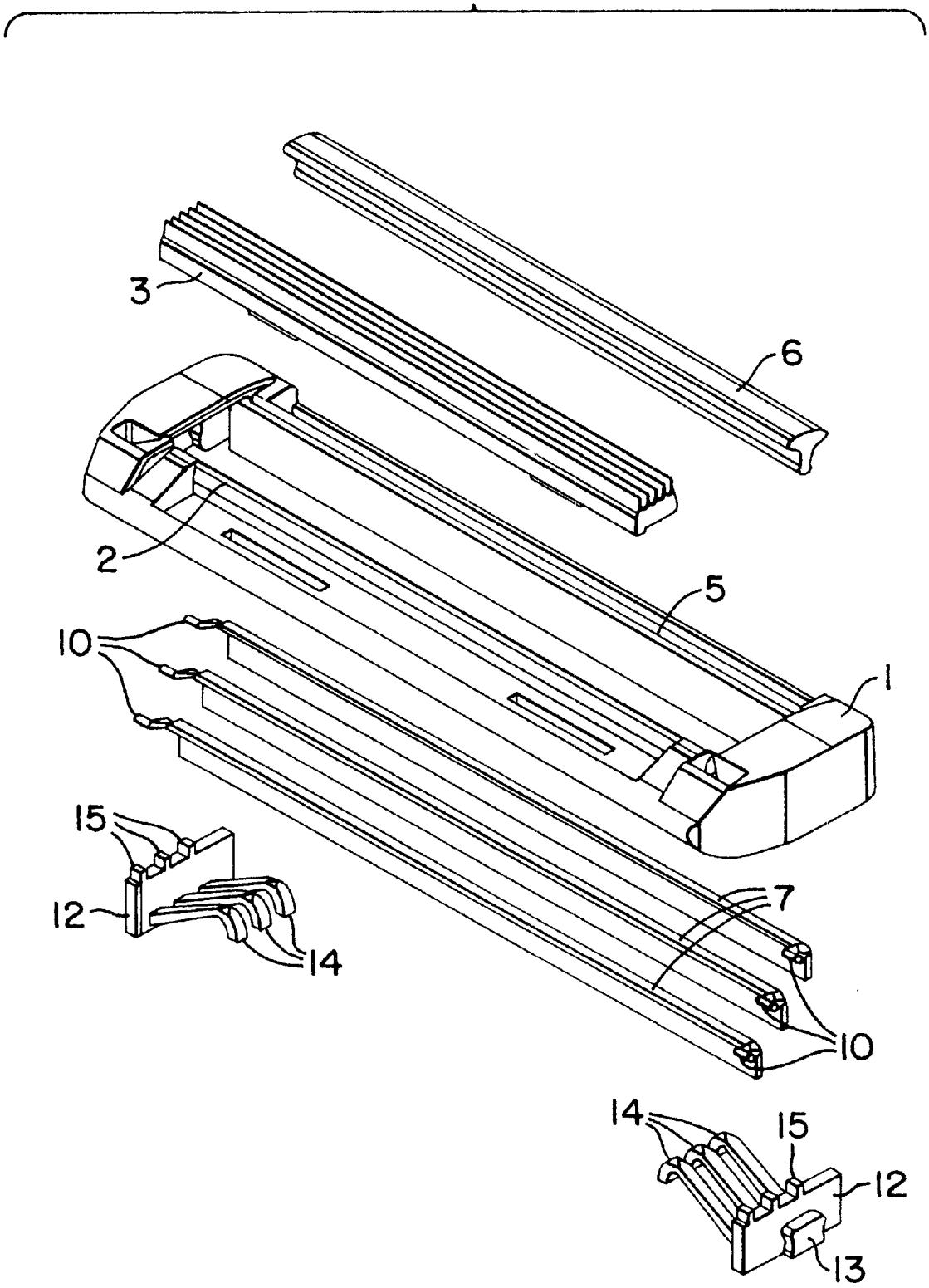
FIG. 3 is an exploded perspective view of the cartridge shown in FIG. 1.
Figure 4:
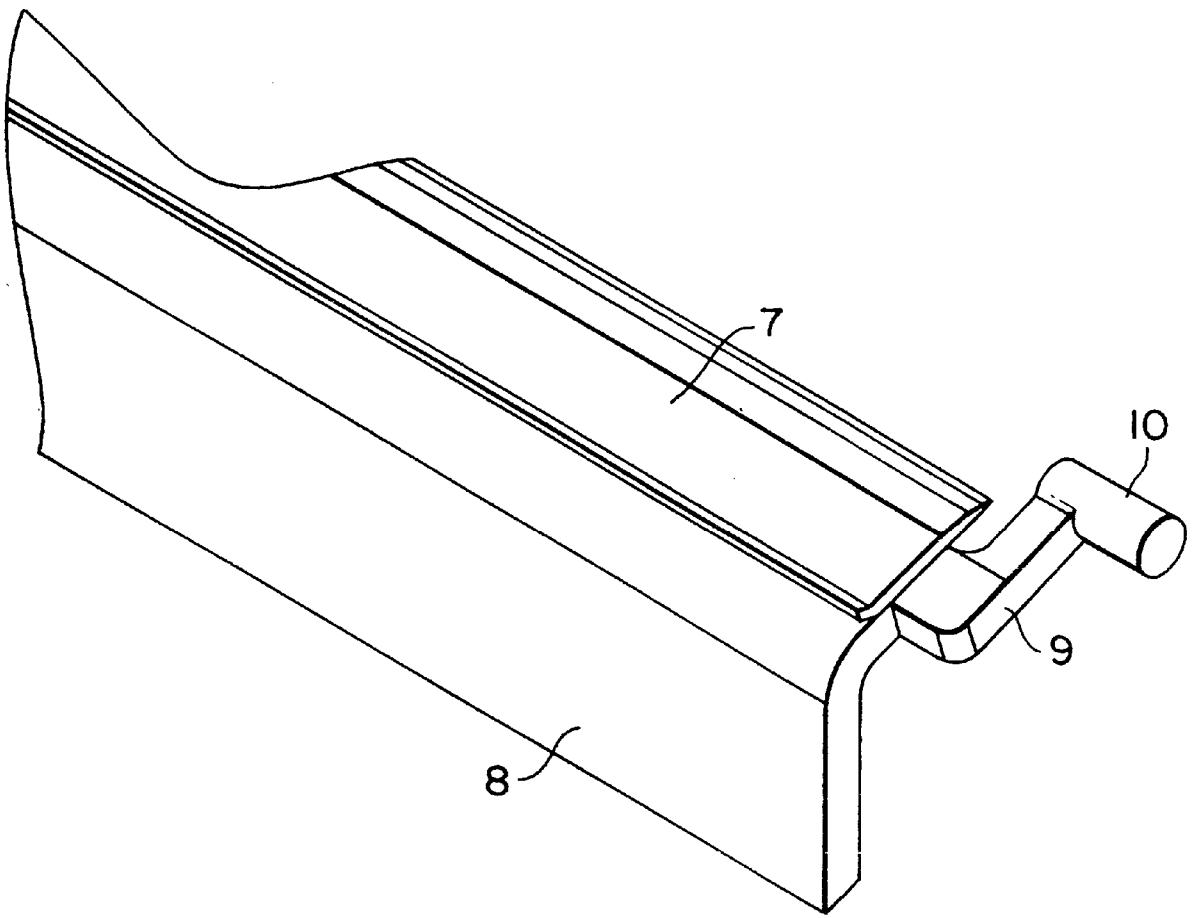
FIG. 4 is an enlarged detail showing part of a blade unit and its support.

The safety razor blade unit shown in FIGS. 1–4 is a shaving cartridge. The handle to which the cartridge is attached is not shown and may be of conventional form. The cartridge comprises a moulded plastics frame 1 of generally rectangular shape. The front rail of the frame includes a guard bar 2 and carries a guard strip 3 of elastomeric material having upstanding fins extending along the strip. The rear rail of the frame defines a cap surface 5 and carries a strip 6 of lubricating material. Three blades 7 with parallel edges are mounted in the frame between the guard bar 2 and cap surface 5 so that the blades pass in turn over the skin during shaving. Each blade is fixedly attached to a blade support 8, and as best seen in FIG. 4, integral with each end of the blade support is a forwardly and upwardly inclined suspension arm 9 having a journal 10 at its free end. The journal axis is parallel to the edge of the blade and spaced forwardly therefrom at a distance of 0.2 to 0.6 mm. The journals are received in bearings defined by spring blocks 12 and the end walls of the cartridge frame. The spring blocks have connection elements 13 which engage with a snap fit in sockets formed in the frame walls, and integral with the spring blocks are spring fingers 14 which act on the undersides of the respective blades for urging the blades to their rest positions shown in FIG. 1. Upwardly directed key elements 15 on the spring blocks are arranged to extend into slots formed in the end walls of the frame to retain the journals 10 in their bearings defined at the upper ends of these slots, as may be seen in FIGS. 1 and 2. Be this arrangement each blade 7 is mounted in the cartridge frame 1 for pivotal movement about the axis defined by the journals 10, this axis being located between the blade edge, and the skin contacting member next in front of the blade, this axis being in or closely-adjacent the tangent plane T of the blade. The spring fingers 14 bias the blades to the rest position of FIG. 1 in which the blades, or their support, abut against shoulders 18 formed on the frame end walls. When a blade 7 is subjected to a load force, applied at the blade edge and directed substantially perpendicular to the shaving plane, and the load force is of sufficient magnitude to overcome the prestress in the spring fingers 14, the blade is caused to pivot so that the blade tangent angle A gradually increases as the load force increases further. As may be seen from FIG. 2, the blade exposure reduces, but only slightly if desired, the reduction in exposure could be compensated by arranging for the guard bar 2 to be itself spring mounted or to be elastically deformable so that it will be gradually depressed under the corresponding load force applied on the guard bar as the blades pivot under the load forces imparted on the blades. It will be understood that the cartridge construction is such that the blade tangent angles will increase with increasing force used by the razor user to press the razor against the skin being shaved.

Figure 5:
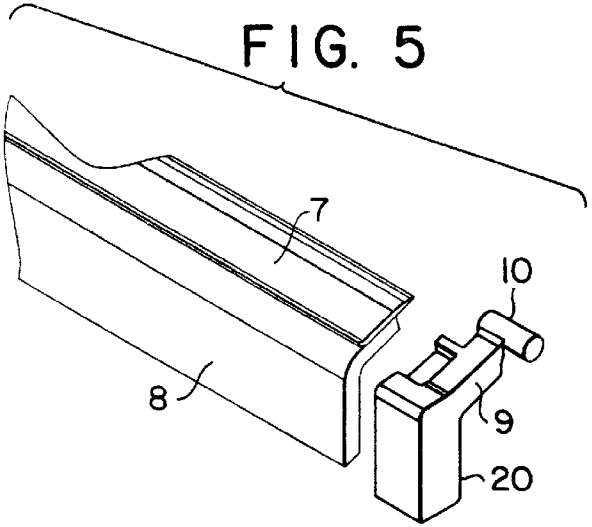
FIG. 5 is a perspective view showing a modified blade mounting arrangement.

Instead of being formed integrally with the blade support, as shown in FIG. 5, the suspension arms 9 and journals 10 can be formed as a separate moulded members 20 which can be formed with slots to receive the ends of the blade support 8.

Figure 6A:
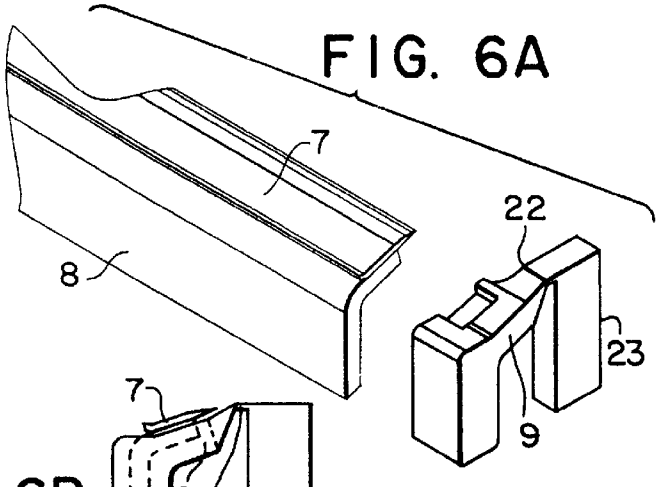
FIGS. 6A and 6B are perspective and end views showing an alternative blade mounting arrangement with a hinge.
Figure 6B:
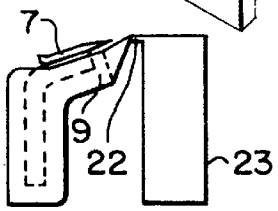

FIGS. 6A and 6B illustrate an arrangement in which a fulcrum about which a blade 7 is pivotable is formed by a living hinge 22 incorporated in a member 23 including the suspension arm 9. The member 23 may be integral with the cartridge frame 1 or can be moulded separately and attached to it.

Figure 7B:
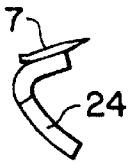
FIGS. 7A and 7B are perspective and end views showing another alternative blade mounting arrangement with a shell bearing.
Figure 7A:
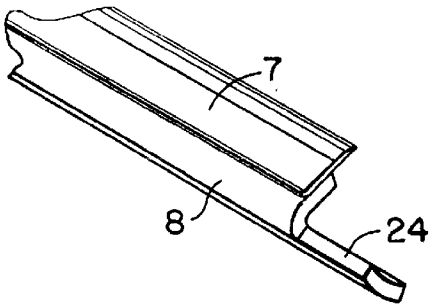

In the alternative construction of FIGS. 7A and 7B the blade support is arcuate and end extensions 24 on the support are arranged to fit into correspondingly curved slots in the frame end walls to form a shell bearing defining the center of pivotal movement of the blade 7.

Figure 8A:
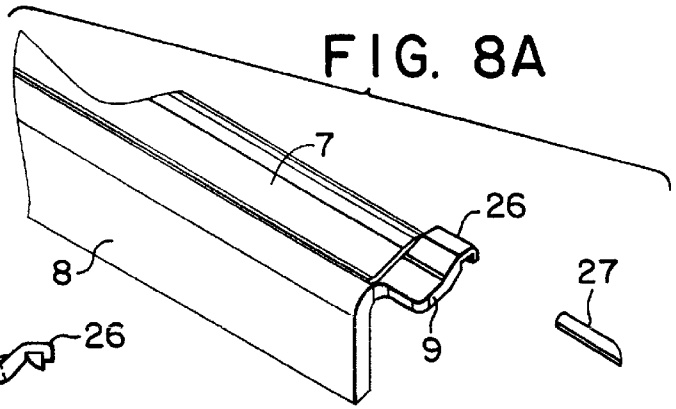
FIGS. 8A and 8B are perspective and end views showing a further alternative blade mounting arrangement with a moving fulcrum.
Figure 8B:
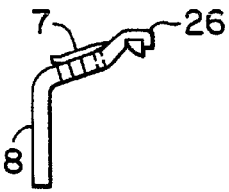

It is not essential for each of the blades to be constrained to move about a fixed fulcrum or pivot axis. In the modified construction of FIGS. 8A and 8B, the suspension arms 9 showing integral with the blade support although they could be moulded separately and attached to the blade support as in FIG. 5, have hooks 26 at their free forward ends. The hooks 26 rest on cantilever support bars 27 fixed to the frame end walls and having substantially flat surfaces with opposite edges defining respective pivot axes. During initial pivotal displacement of the blade, the suspension arms 9 and blade 7 pivot about the axis defined by the forward edges of the support bars 27, and during subsequent angular movement the pivoting takes place about the pivot axis defined by the rear edges of support bars.

Figure 9A:
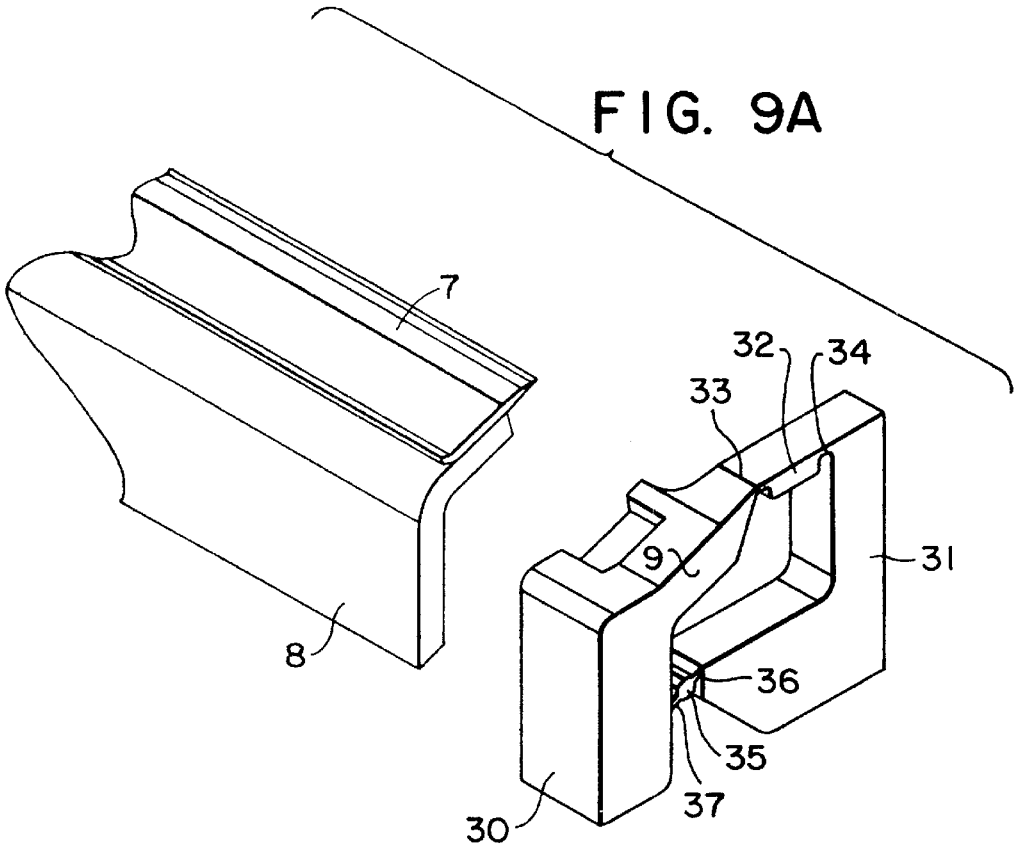
FIGS. 9A and 9B show in perspective and end view a blade mounting arrangement including a four bar linkage.
Figure 9B:
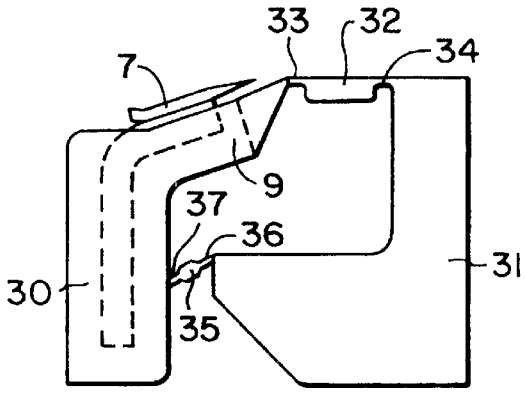
Figure 9C:
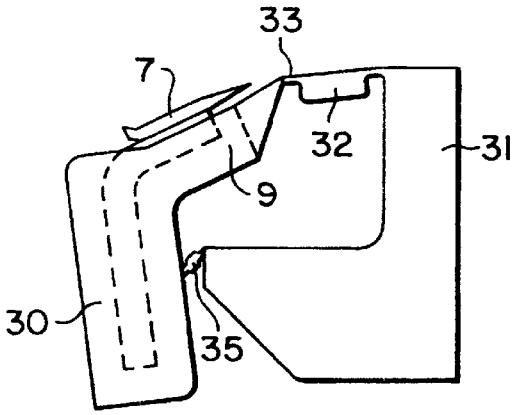
FIG. 9C shows this embodiment in a maximum blade displacement condition.

In the modified embodiment of FIGS. 9A, 9B and 9C, the blades 7 are supported by integrally moulded four bar linkage assemblies. A first link 30 forms the suspension arm 9, a second L-shaped link 31, is fixed to the cartridge frame, a third link 32 is connected to the suspension arm 9 by one living hinge 33 defining a fulcrum for movement of the blade 7, and to one end of the second link 31 by another living hinge 34, and a fourth link 35 of short length is connected by respective living hinges 36, 37 to the other end of the second link and to the first link. Under load forces applied at the blade edge the link 30 moves about the fulcrum defined by the hinge 33. There is some downward movement of the fulcrum due to the hinge 34, but this displacement which will result in reduction of the blade exposure, is only small due to the short length of the fourth link 35. In all the described embodiments the fulcrums will be located substantially as described in relation to the embodiment of FIGS. 1–4 and as a consequence the desired effect of the blade tangent angles increasing as the load forces increase is obtained, while the blade spans do not change substantially, and the changes to the blade exposures are kept small.

What is claimed is:

1. A safety razor blade unit having at least one blade including a blade edge for shaving, said blade being mounted for independent movement relative to other skin contacting parts of the blade unit under forces exerted at the blade edge during shaving, said blade unit defining a tangent plane which is a plane tangent to the blade edge and the surface of the skin contacting part next in front of the blade, said blade defining a tangent angle which is the angle at which the central plane of the blade intersects the tangent plane, wherein said blade is mounted to move to increase the blade tangent angle in response to load forces exerted on the blade during shaving, wherein the blade unit includes a frame, and said blade is fixedly carried on a blade support, and the blade support is connected to the frame by means defining a fulcrum, the movement of the blade comprising angular displacement about said fulcrum, and the fulcrum being located closer to the blade edge than is the point where the tangent plane meets the skin contacting surface next in front of the blade, and wherein the blade support has a suspension arm engaged with a support bar fixed to the frame and having opposite edges about which the suspension arm pivots sequentially as the angular displacement of the blade increases.

2. A safety razor blade unit having at least one blade including a blade edge for shaving, said blade being mounted for independent movement relative to other skin contacting parts of the blade unit under forces exerted at the blade edge during shaving, said blade unit defining a tangent plane which is a plane tangent to the blade edge and the surface of the skin contacting part next in front of the blade, said blade defining a tangent angle which is the angle at which the central plane of the blade intersects the tangent plane, wherein said blade is mounted to move to increase the blade tangent angle in response to load forces exerted on the blade during shaving, wherein the blade unit includes a frame, and said blade is fixedly carried on a blade support, and the blade support is connected to the frame by means defining a fulcrum, the movement of the blade comprising angular displacement about said fulcrum, and the fulcrum being located closer to the blade edge than is the point where the tangent plane meets the skin contacting surface next in front of the blade, and wherein the fulcrum lies in or closely adjacent to the tangent plane and the fulcrum comprises a living hinge.

3. A safety razor blade unit having at least one blade including a blade edge for shaving, said blade being mounted for independent movement relative to other skin contacting parts of the blade unit under forces exerted at the blade edge during shaving, said blade unit defining a tangent plane which is a plane tangent to the blade edge and the surface of the skin contacting part next in front of the blade, said blade defining a tangent angle which is the angle at which the central plane of the blade intersects the tangent plane, wherein said blade is mounted to move to increase the blade tangent angle in response to load forces exerted on the blade during shaving, wherein the blade unit includes a frame, and said blade is fixedly carried on a blade support, and the blade support is connected to the frame by means defining a fulcrum, the movement of the blade comprising angular displacement about said fulcrum, and the fulcrum being located closer to the blade edge than is the point where the tangent plane meets the skin contacting surface next in front of the blade, and wherein the fulcrum lies in or closely adjacent to the tangent plane and the fulcrum comprises a shell bearing.

4. A safety razor blade unit having at least one blade including a blade edge for shaving, said blade being mounted for independent movement relative to other skin contacting parts of the blade unit under forces exerted at the blade edge during shaving, said blade unit defining a tangent plane which is a plane tangent to the blade edge and the surface of the skin contacting part next in front of the blade, said blade defining a tangent angle which is the angle at which the central plane of the blade intersects the tangent plane, wherein said blade is mounted to move about a Divot axis displaced from the blade edge and located in or closely adjacent to the tangent plane to increase the blade tangent angle in response to load forces exerted on the blade during shaving.

5. A safety razor blade unit according to claim 4, wherein the blade unit includes a frame, and the or each blade is fixedly carried on a blade support, and the blade support is connected to the frame by means defining a fulcrum, the movement of the blade comprising angular displacement about said fulcrum, and the fulcrum being located closer to the blade edge than is the point where the tangent plane meets the skin contacting surface next in front of the blade.

6. A safety razor blade unit according to claim 5, wherein the fulcrum is fixed with respect to the frame and defines an axis about which the blade support and blade pivot.

7. A safety razor blade unit according to claim 6, wherein the fulcrum comprises journals provided at the opposite ends of the blade support and engaged in bearings in the frame.

8. A safety razor blade unit according to claim 5, wherein the blade support is connected to the frame so that the fulcrum moves relative to the frame during angular displacement of the blade.

9. A safety razor blade unit according to claim 5, wherein the fulcrum is spaced from the blade edge at a distance in the range of 0.2 mm to 0.6 mm.

10. A safety razor blade unit according to claim 4, wherein the pivot axis is located between the blade edge and the skin contacting surface next in front of the blade.

11. A safety razor blade unit according to claim 4, which includes a plurality of blades having parallel cutting edges, each blade being mounted for pivotal movement about a pivot axis displaced from its cutting edge and located in or closely adjacent to the tangent plane of the blade.

* * * * *

UNITED STATES PATENT AND TRADEMARK OFFICE

CERTIFICATE OF CORRECTION

PATENT NO. : 6,173,498
DATED : January 16, 2001
INVENTOR(S) : Paul Leslie Warrick et al It is certified that error appears in the above-identified patent and that said Letters Patent is hereby corrected as shown below:

Claim 4, col. 6, line 7, change "Divot" to --pivot--.

Signed and Sealed this

Eighth Day of May, 2001

*Attest:*

Nicholas P. Godici

NICHOLAS P. GODICI

*Attesting Officer*

*Acting Director of the United States Patent and Trademark Office*